US005302146A

United States Patent [19]

Yamamoto

[11] Patent Number: 5,302,146

[45] Date of Patent: Apr. 12, 1994

[54] CRIMP-STYLE TERMINAL

[75] Inventor: Masaya Yamamoto, Shizuoka, Japan

[73] Assignee: Yazaki Corporation, Tokyo, Japan

[21] Appl. No.: 957,903

[22] Filed: Oct. 8, 1992

[30] Foreign Application Priority Data

Oct. 14, 1991 [JP] Japan ..... 3-083003[U]

[51] Int. Cl.[5] ..... H01R 4/18

[52] U.S. Cl. ..... 439/877; 439/865

[58] Field of Search ..... 439/865-868, 439/877-882; 174/74 R, 84 C, 94 R

[56] References Cited

U.S. PATENT DOCUMENTS

| | | | |
|---|---|---|---|
| 301,819 | 7/1884 | Jones | 439/877 |
| 2,142,818 | 1/1939 | Jacobson | 439/865 |
| 2,983,898 | 5/1961 | Kalmar et al. | 439/877 |
| 3,182,282 | 5/1965 | Turner | 439/882 |
| 4,669,798 | 6/1987 | Daum et al. | 439/877 |

FOREIGN PATENT DOCUMENTS

| | | |
|---|---|---|
| 53-137685 | 10/1978 | Japan . |
| 59-2871 | 1/1984 | Japan . |
| 60-57077 | 4/1985 | Japan . |
| 61-166372 | 10/1986 | Japan . |

*Primary Examiner*—Gary F. Paumen

*Attorney, Agent, or Firm*—Sughrue, Mion, Zinn, Macpeak & Seas

[57] ABSTRACT

A crimp-style terminal for a cable includes a base plate serving as a main body for the terminal. One end of the base plate serves as a female type electrical contact section, while the other end of the same serves as a clamping section. A conductor clamping portion and a sheath clamping portion are arranged in the clamping section for tightly holding an unsheathed conductor and sheath of the cable, respectively. A raised flat bottom portion is arranged in the conductor clamping portion so that the conductor of the cable is clamped between a pair of conductor clamping pieces on the raised flat bottom portion. A convex projection is formed in the sheath clamping section so that the sheath of the cable is clamped by a pair of sheath clamping pieces in a state where the sheath of the cable is bent.

7 Claims, 2 Drawing Sheets

CRIMP-STYLE TERMINAL

BACKGROUND OF THE INVENTION

The present invention relates generally to a crimp-style terminal for a cable. More particularly, the present invention relates to improvement of a crimp-style terminal of the foregoing type which assures that a strength of the terminal against cable disconnection or breakage at cable conductor clamping portions is substantially increased.

To facilitate an understanding of the present invention, a typical conventional crimp-style terminal for a cable will be described below with reference to FIG. 4 and FIG. 5.

FIG. 4 is a perspective view of the conventional crimp-style terminal which is disclosed in an official gazette of Japanese Utility Model Laid-Open Publication NO. 61-166372.

The crimp-style terminal generally designated by reference numeral 16 includes a base plate 17 of which one end serves as a female type electrical contact section 19 having a leaf spring 18 received therein and of which the other end serves as a clamping portion comprising a pair of conductor clamping pieces 21 for clamping unsheathed conductors 20 extending from a cable 18 and a pair of sheath clamping pieces 23 for clamping a sheath 22 of the cable 18.

While the cable 18 is placed on the base plate 17 to extend in the longitudinal direction, the conductor clamping pieces 21 and the sheath clamping pieces 23 are inwardly folded by actuating jigs (not shown) so that the conductors 20 are tightly held by the conductor clamping pieces 21 and the sheath 22 is tightly held by the sheath clamping pieces 23 in the clamped state. FIG. 5 is a fragmentary sectional view of the terminal taken along line B—B in FIG. 4, particularly illustrating the operative state that the conductors 20 and the sheath 22 are tightly clamped by the conductor clamping pieces 21 and the sheath crimping pieces 23. In FIG. 4, reference numeral 24 designates engagement pieces each projecting from the base plate 17. The engagement pieces 24 are used for allowing the terminal 16 to be fixedly secured to the inside of a connector (not shown).

With the conventional crimp-style terminal constructed in the above-described manner, however, there arises a problem that when a certain intensity of pulling force P is abruptly applied to the cable 18, a high stress is exerted concentratively on stepped parts 25 of the conductors 20 formed by the tight crimping action of the conductor clamping pieces 21, resulting in the conductors 20 being broken at the stepped parts 25, or the cable 18 itself is disconnected from both the clamping portions 26 and 27.

SUMMARY OF THE INVENTION

The present invention has been made in consideration of the foregoing background.

An object of the present invention is to provide a crimp-style terminal wherein a cable is prevented from being broken or disconnected from the terminal even when intense pulling force is applied to the cable.

According to the present invention, there is provided a crimp-style terminal with an electrical contact section at one end thereof and a cable clamp section at the other end thereof, the cable clamp section comprising: a conductor clamp portion for clamping an unsheathed conductor of a cable; a sheath clamp portion for clamping a sheath of the cable; and a raised flat bottom portion arranged in the conductor clamp portion for aligning the unsheathed conductor to extend straightly from the sheath of the cable. The Preferably, the cable clamp section further comprises a convex projection arranged in the sheath clamp portion for bending a part of the sheath.

The conductor clamp portion may preferably include a pair of conductor clamp pieces each adapted to be inwardly folded so as to tightly clamp the unsheathed conductor on the raised flat bottom portion.

The sheath clamp portion may preferably include a pair of sheath clamp pieces adapted to be inwardly folded and located positionally offset from each other in a longitudinal direction of the crimp-style terminal so that the convex projection is located between the pair of sheath clamp pieces in the longitudinal direction.

Other objects, features and advantages of the present invention will become apparent from reading of the following description which has been prepared in conjunction with the accompanying drawings.

BRIEF DESCRIPTION OF THE DRAWINGS

The present invention is illustrated in the following drawings in which.

DESCRIPTION OF THE PREFERRED EMBODIMENT

Figure 1:
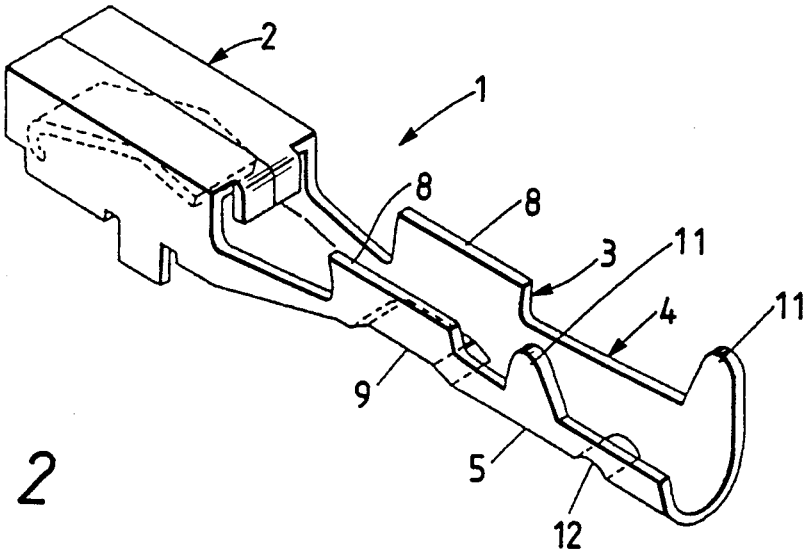
FIG. 1 is a perspective view of a crimp-style terminal for a cable in accordance with an embodiment of the present invention.
Figure 2:
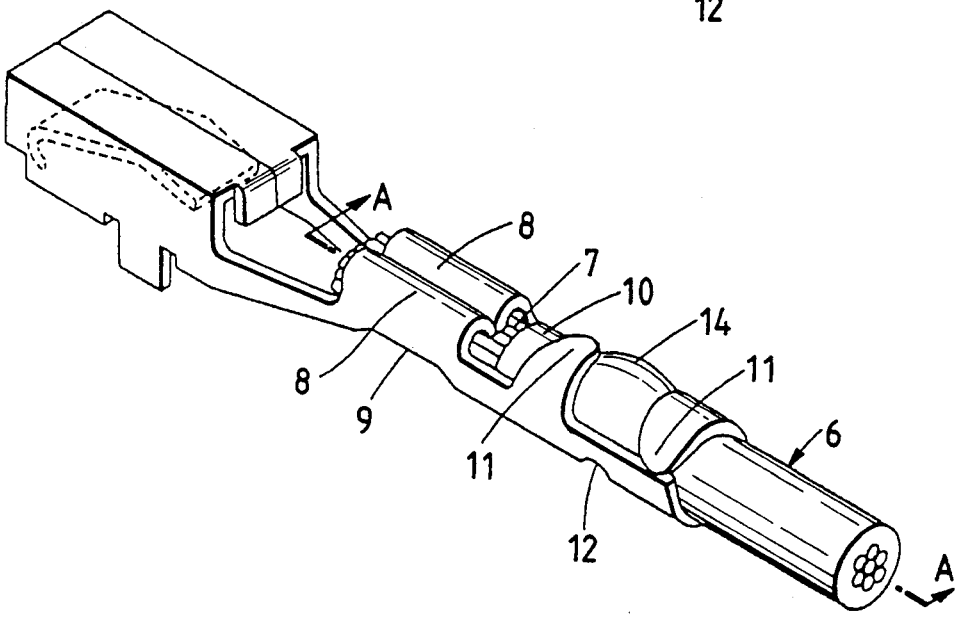
FIG. 2 is a perspective view of the crimp-style terminal shown in FIG. 1, particularly illustrating the operative state that unsheathed conductors extending a cable are tightly held in the clamped state.

The present invention will now be described in detail hereinafter with reference to FIG. 1 to FIG. 3 which illustrate a preferred embodiment of the present invention.

A crimp-style terminal 1 includes a base plate 5 serving as a main body for the terminal, one end of the base plate 5 serves as a female type electrical contact section 2, while the other end of the same serves as a clamping section comprising a conductor clamping portion 3 and a sheath clamping portion 4. Specifically, the female type electrical contact section 2 is formed on the left-hand side of the base plate 5, a pair of conductor clamping pieces 8 are formed at the intermediate part of the base plate 5 for tightly holding unsheathed conductors 7 extending from the cable 6 in the clamped state, and a pair of sheath clamping pieces 11 are formed on the right-hand side of the base plate 5 for tightly holding a sheath 10 of the cable 6 in the clamped state. It should be added that a raised flat bottom portion 9 is formed at the intermediate part of the base plate 5 and a convex projection 12 is formed between the sheath clamping pieces 11 on the right-hand side of the base plate 5 for bending the cable 6.

Figure 3:
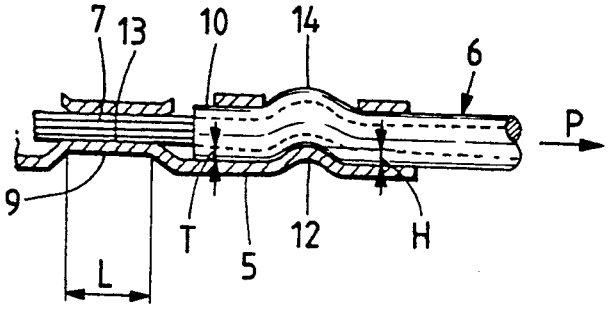
FIG. 3 is a fragmentary sectional view of the crimp-style terminal taken along line A—A in FIG. 2.

As shown in FIG. 3, the raised flat bottom portion 9 is raised up from the base plate 5 by a height T substantially equal to a thickness of the base plate 5 and has a flat surface 13 having a length L substantially equal to a length of each conductor clamping piece 8. Preferably, the height T corresponds to a radial thickness of the sheath 10 of the cable 6. The convex projection 12 exhibits an inverted substantially V-shaped sectional contour as seen from the side and has a height H substantially equal to the height T of the raised flat bottom portion 9.

Next, a mode of usage of the crimp-style terminal constructed in the aforementioned manner will be described below.

Figure 4:
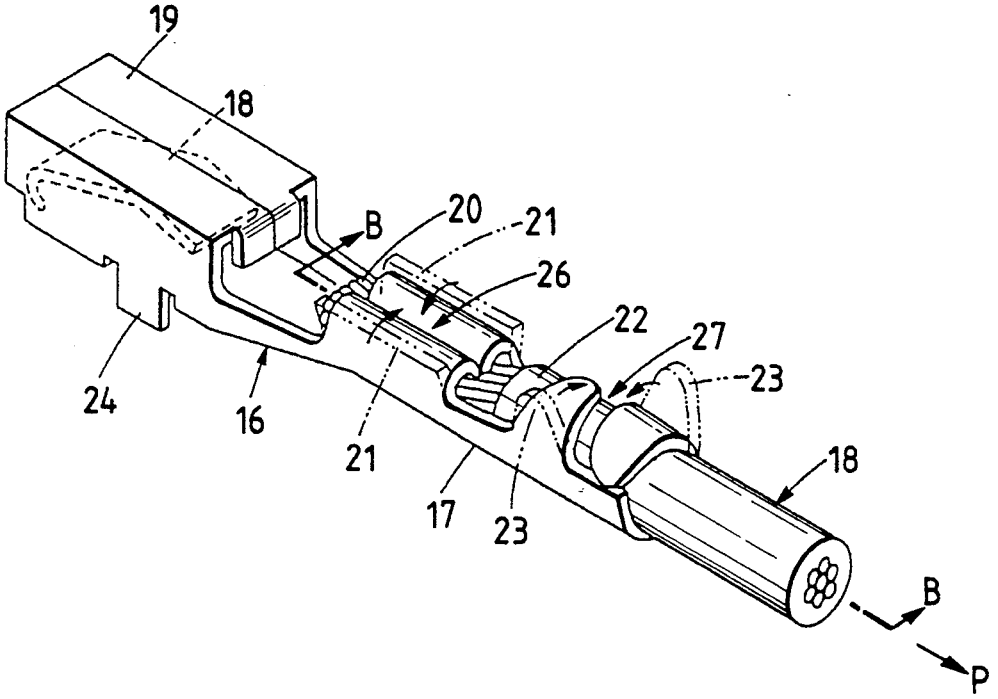
FIG. 4 is a perspective view of a conventional crimp-style terminal for a cable.
Figure 5:
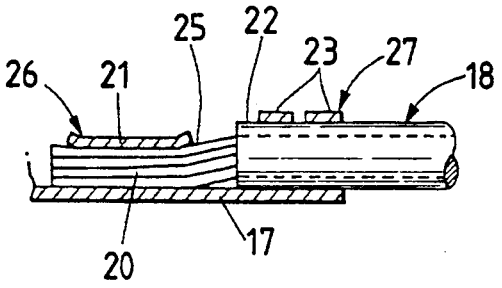
FIG. 5 is a fragmentary sectional view of the crimp-style terminal taken along line B—B in FIG. 4.

First, the cable 6 is placed on both the clamping portions 3 and 4 while extending in the longitudinal direction of the terminal, and thereafter, the conductor clamping pieces 8 and the sheath clamping pieces 11 are inwardly folded by actuating jigs (not shown). Thus, as shown in FIG. 3, the conductors 7 extending from the cable 6 are tightly held between the raised bottom portion 9 and the conductor clamping pieces 8 in the clamped state while maintaining positional alignment with the cable 5. It should be noted that any stepped part (stress concentrating part) is not formed in contrast with the conventional crimp-style terminal described above with reference to FIG. 4 and FIG. 5. In addition, a part of the sheath 10 is upwardly curved to form a bent portion 14 of which fore and rear parts are tightly clamped by the sheath clamping pieces 11. This leads to the result that resistance against disconnection of the cable 6 is substantially increased and a stress appearing in the direction of pulling of the cable 6, i.e., in the P arrow-marked direction is absorbed by the bent portion 14, whereby the cable 6 is surely prevented from being disconnected from the conductor clamping pieces 8 and the sheath clamping pieces 11 and transmission of the pulling force to the conductors 7 can reliably be prevented. Accordingly, the present invention enhances the reliability of the electrical connection in the crimp-style terminal. Further, the present invention is particularly applicable to a crimp-style terminal on which an extremely thin cable is to be clamped, to enhance the electrical connection reliability thereof.

While the present invention has been described above merely with respect to a single preferred embodiment thereof, it should of course be understood that the present invention should not be limited only to this embodiment but various change or modification may be made without departure from the scope of the present invention as defined by the appended claims.

What is claimed is:

1. A crimp-style terminal with an electrical contact section at one end thereof and a cable clamp section comprising:

a conductor clamp portion for clamping an unsheathed conductor of a cable; and a sheath clamp portion for clamping a sheath of said cable; and a convex projection arranged in said sheath clamp portion for bending a part of said sheath, wherein said sheath clamp portion includes a pair of sheath clamp pieces adapted to be inwardly folded and located positionally offset from each other in a longitudinal direction of said crimp-style terminal and wherein said convex projection is located between said pair of sheath clamp pieces in said longitudinal direction.

2. The crimp-style terminal according to claim 1, wherein said conductor clamp portion includes a pair of conductor clamp pieces each adapted to be inwardly folded so as to tightly clamp said unsheathed conductor on said raised flat bottom portion.

3. A crimp-style terminal for a cable comprising:

a base plate having an electrical contact section at one end thereof and a clamp section at the other end thereof;

a conductor clamp portion arranged in said clamp section for tightly clamping an unsheathed conductor of said cable;

a sheath clamp portion arranged in said clamp section for tightly holding a sheath of said cable;

a raised flat bottom portion raised up from said base plate at a portion where said conductor clamp portion is arranged; and a convex projection formed on and projecting from said base plate at a portion where said sheath clamping portion is arranged, wherein said sheath clamp portion includes sheath clamp pieces adapted to be inwardly folded and located positionally offset from each other in a longitudinal direction of said crimp-style terminal and wherein said convex projection is located between said pair of sheath clamp pieces in said longitudinal direction.

4. The crimp-style terminal according to claim 3, wherein said raised flat bottom portion is raised up from said base plate by a height substantially equal to a thickness of said base plate.

5. The crimp-style terminal according to claim 3, wherein said raised flat bottom portion has a length substantially equal to a length of said conductor clamp portion.

6. The crimp-style terminal according to claim 3, wherein said convex projection is upwardly bent from said base plate to exhibit an inverted substantially V-shaped sectional contour.

7. The crimp-style terminal according to claim 4, wherein said convex projection has a height substantially equal to said height of said raised flat bottom portion.

* * * * *